US011280549B2

(12) United States Patent
Dorst et al.

(10) Patent No.: US 11,280,549 B2
(45) Date of Patent: Mar. 22, 2022

(54) MULTI-PART SUPPORT ELEMENT FOR SPACING CARRIER ELEMENTS

(71) Applicant: SAINT-GOBAIN INDUSTRIEKERAMIK RÖDENTAL GMBH, Rödental (DE)

(72) Inventors: Hans-Ulrich Dorst, Rödental (DE); Wolfgang Schneider, Sonneberg (DE)

(73) Assignee: SAINT-GOBAIN INDUSTRIEKERAMIK RÖDENTAL GMBH, Rödental (DE)

( * ) Notice: Subject to any disclaimer, the term of this patent is extended or adjusted under 35 U.S.C. 154(b) by 0 days.

(21) Appl. No.: 17/254,090

(22) PCT Filed: Jun. 18, 2019

(86) PCT No.: PCT/EP2019/065977
§ 371 (c)(1),
(2) Date: Dec. 18, 2020

(87) PCT Pub. No.: WO2019/243309
PCT Pub. Date: Dec. 26, 2019

(65) Prior Publication Data

US 2021/0270531 A1 Sep. 2, 2021

(30) Foreign Application Priority Data

Jun. 20, 2018 (DE) ..... 10 2018 114 817.8

(51) Int. Cl.
*F27D 5/00* (2006.01)

(52) U.S. Cl.
CPC ..... *F27D 5/0006* (2013.01)

(58) Field of Classification Search
CPC ..... F27D 5/00; F27D 5/0012; F27D 5/0018; F27D 5/0025; A47B 57/565; A47B 45/00; F16M 11/02; F16M 11/04; F16M 11/08
See application file for complete search history.

(56) References Cited

U.S. PATENT DOCUMENTS 1,860,374 A * 5/1932 Vincent ..... F27D 5/0025 432/259
2,881,502 A * 4/1959 Dopera ..... F27D 5/0018 432/259

(Continued)

FOREIGN PATENT DOCUMENTS

DE 2817887 A1 * 10/1979 ..... F27D 5/0025
DE 4312742 C1 * 11/1994 ..... F27D 5/0025

(Continued)

OTHER PUBLICATIONS

International Search Report as issued in International Patent Application No. PCT/EP2019/065977, dated Sep. 9, 2019.

*Primary Examiner* — Gregory A Wilson

(74) *Attorney, Agent, or Firm* — Pillsbury Winthrop Shaw Pittman LLP

(57) ABSTRACT

A multi-part support element for spacing carrier elements, includes an upper part and a lower part, wherein the upper part can be detachably axially connected to the lower part by a rotary connection in order to fix a carrier element between the upper part and the lower part, the rotary connection is formed by a stud provided on the lower part and an opening provided on the upper part, into which the stud can be screwed, and the rotary connection is implemented such that the rotary connection is released again after defined screwing of the stud into the opening, such that the stud is locked in the opening with axial play, and wherein the lower part has a disk-shaped attachment, whose layer thickness decreases toward the edge.

11 Claims, 15 Drawing Sheets

(56) References Cited

U.S. PATENT DOCUMENTS

| | | | | |
|---|---|---|---|---|
| 3,756,581 | A * | 9/1973 | Albertini | F27D 5/0006 432/258 |
| 9,862,649 | B2 * | 1/2018 | Watanabe | F27D 5/00 |
| 2015/0241127 | A1 * | 8/2015 | Sonntag | F27D 5/0012 432/258 |

FOREIGN PATENT DOCUMENTS

| | | | | |
|---|---|---|---|---|
| DE | 10 2008 022159 | A1 | 11/2009 | |
| DE | 20 2014 100848 | U1 | 5/2014 | |
| EP | 3156750 | A1 * | 4/2017 | F27D 5/0018 |
| JP | 02247496 | A * | 10/1990 | |
| WO | WO 2007/132276 | A1 | 11/2007 | |

* cited by examiner

MULTI-PART SUPPORT ELEMENT FOR SPACING CARRIER ELEMENTS

CROSS-REFERENCE TO RELATED APPLICATIONS

This application is the U.S. National Stage of PCT/EP2019/065977, filed Jun. 18, 2019, which in turn claims priority to German patent application number 10 201 8 114 817.8 filed Jun. 20, 2018. The content of these applications are incorporated herein by reference in their entireties.

FIELD

The invention relates to a multi-part support element for spacing carrier element arranged one above the other, in particular kiln furniture elements such as plate setter disks or firing batts. These carrier elements are manually or even automatically stacked to form stacks or towers, with support elements (also called spacers) forming the distance between them. The products to be fired are introduced into the free spaces created between levels. This loading with the products to be fired can again be done manually or automatically.

BACKGROUND

Multi-part support elements for kiln shelves are known from the prior art, for example, from WO 2007/132276 A1. Two-part bolted supports for automated kiln loading and unloading systems were developed and used to eliminate a significant disadvantage of loosely mounted, usually one-piece supports. The disadvantage of loosely mounted, usually one-piece supports consists in that when adhesive effects occur between such a support and the shelf above it, for example, in the form of a plate setter, lifting of the shelf support out of its centering bore, in which it is customarily fixed with a stud in the plane of the plate setter, regularly occurs. The consequences are interruptions of the operating cycle and breakage of plate setters and items to be fired while unstacking and re-forming the plate setter stacks, as is common in automated kiln loading and unloading systems.

WO 2007/132276 A1 discloses multi-part support elements that comprise an upper part and a lower part, wherein, on the top side of the lower part, a stud having an external thread is provided, which is screwed with an internal thread provided in an opening on the bottom side of the upper part. The plate setter or the firing batt is fixedly screwed in as a shelf between the upper and the lower part. The disadvantage of this existing solution consists in that due to the material properties of the highly temperature resistant ceramic materials used for supports and plate setters or firing batt, no secure non-positive connection can be achieved by applying a pre-tension in the threaded stud. The thermal stress during use in the kiln often results in breakage of the threaded stud or in loosening of the screwed connection. However, a loose screwed connection, in which the plate setter or the firing batt is not adequately clamped between the upper and lower part of the support element, again creates mechanical stress on the stud due to the dissipation of weight forces caused by the plate setter and batts as well as items to be fired located above, which can likewise result in breakage of the threaded stud.

DE 10 2008 022 159 A1 discloses a multi-part support element for a kiln shelf, comprising an upper part and a lower part, which can be detachably axially connected by means of a rotary connection in order to fix a shelf between the upper part and the lower part. The rotary connection is formed by a stud provided on one part and a corresponding opening into which the stud can be screwed provided on the respective other part. The rotary connection is implemented such that, after defined screwing of the stud into the opening, the rotary connection is released again such that the stud is locked in the opening with axial play. The lower part of the support element includes a disk-shaped region and a stud projecting upward from the disk-shaped region, wherein the disk-shaped region includes, on its upper side, a planar support surface, perpendicular to the stud and surrounding the stud in the shape of a ring, for the shelf to be fixed between the upper part and the lower part.

The multi-part support element disclosed in DE 10 2008 022 159 A1 prevents accidental lifting of the upper part caused by adhesion of the upper support surface of the upper part to the lower part of the next higher support element or to the shelf arranged above it by locking the upper part to the associated lower part arranged below it. In addition, in the case of the multi-part support element disclosed in DE 10 2008 022 159 A1 in the stacked state of the kiln shelf, no excessive forces, in particular not the entire weight force of the shelves, supports, and items to be fired arranged above the stud, are dissipated via the sensitive studs, since, during operation, the studs are not rotatably connected to the opening surrounding them, but instead are guided within it with axial play, with the weight forces dissipated via the supporting surfaces provided for this on the upper and lower part of the support element.

A disadvantage of the multi-part support element disclosed in DE 10 2008 022 159 A1 is that the shelf to be fixed between the upper part and the lower part rests on the planar support surface of the disk-shaped region of the lower part, which surface is perpendicular to the stud and surrounds the stud in the shape of a ring, i.e., the disk-shaped region of the lower part protrudes out of the shelf to be fixed. This partial protrusion of the lower part out of bottom of the shelf is disadvantageous for the transport of the kiln shelf elements on roller conveyors during automated stacking and unstacking of the kiln shelf elements.

SUMMARY

Proceeding from this, the object of the invention is to provide a multi-part support element for spacing carrier elements of a kiln shelf that overcomes the aforementioned disadvantages of the prior art, ensures disruption-free operation of the kiln shelf in the kiln as well as during automated stacking and unstacking of the individual components, and is characterized by a simple design and a long service life even at the highest kiln temperatures.

The object of the present invention is accomplished by a multi-part support element according to the independent claim 1. Preferred embodiments emerge from the dependent claims.

In an aspect of the invention, there is provided a multi-part support element for spacing carrier elements, including an upper part and a lower part, wherein the upper part is configured to be detachably axially connected to the lower part by a rotary connection in order to fix a carrier element between the upper part and the lower part, the rotary connection is formed by a stud provided on the lower part and an opening provided on the upper part, into which the stud is to be screwed, and the rotary connection is implemented such that the rotary connection is released again after defined screwing of the stud into the opening, such that the stud is locked in the opening with axial play, and wherein the lower part has a disk-shaped attachment, whose layer thickness decreases toward the edge.

In another aspect of the invention, there is provided a kiln shelf element, including a carrier element having a bottom, a top opposite the bottom, and at least one bore, wherein the bore is enlarged toward the bottom; and at least one support element as described herein, wherein the carrier element is fixed between the upper part and the lower part of the multi-part support element, and the disk-shaped attachment of the lower part of the support element is accommodated in the bore such that the support element does not protrude from the carrier element at the bottom of the carrier element.

BRIEF DESCRIPTION OF THE DRAWINGS

The invention is explained in detail with reference to drawings. The drawings are schematic representations and not to scale. The drawings in no way restrict the invention. They depict.

DETAILED DESCRIPTION

Figure 1:
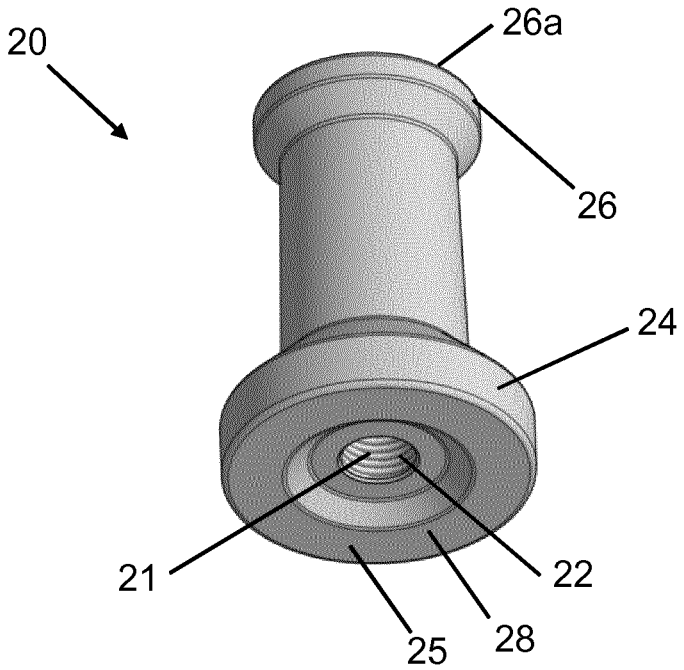
FIG. 1 a perspective view of an embodiment of an upper part of a support element according to the invention, FIG. 2 a side view of another embodiment of an upper part of a support element according to the invention, FIG. 3 a cross-section of the upper part of FIG. 2 along the section line A-A, FIG. 4 a perspective view of another embodiment of an upper part of a support element according to the invention, FIG. 5 a perspective view of an embodiment of a lower part of a support element according to the invention, FIG. 6 a side view of another embodiment of a lower part of a support element according to the invention, FIG. 7 a cross-section of the lower part of FIG. 6 along the section line A-A, FIG. 8 a side view of an embodiment of a kiln shelf element according to the invention, FIG. 9 a detail of a cross-section of the kiln shelf element according to the invention of FIG. 8 along the section line A-A, FIG. 10 a detail of a cross-section of another embodiment of a kiln shelf element according to the invention, FIG. 11 a detail of a cross-section of another embodiment of a kiln shelf element according to the invention, FIG. 12 a side view of an embodiment of a kiln shelf according to the invention, FIG. 13 a cross-section of a detail of the kiln shelf of FIG. 12 along the section line A-A, FIG. 14 a cross-section of a detail of another embodiment of a kiln shelf according to the invention, FIG. 15 a cross-section of a detail of another embodiment of a kiln shelf according to the invention, FIG. 16 a perspective view of an embodiment of a kiln shelf element according to the invention, FIG. 17 a perspective bottom view of a detail of the kiln shelf element of FIG. 16, FIG. 18 a perspective view of an embodiment of a kiln shelf according to the invention, FIG. 19 a perspective view of another embodiment of a kiln shelf according to the invention, FIG. 20 a perspective view of a detail of the kiln shelf of FIG. 19, FIG. 21 a perspective view of another embodiment of an upper part of a support element according to the invention, FIG. 22 a perspective view of a detail of the upper part of FIG. 21, FIG. 23 a cross-section of the upper part of FIG. 21, FIG. 24 a perspective view of another embodiment of a lower part of a support element according to the invention, FIG. 25 a detail of a cross-section of another embodiment of a kiln shelf element according to the invention, and FIG. 26 a perspective view of another embodiment of a lower part of a support element according to the invention.

A multi-part support element according to the invention for spacing carrier elements comprises at least an upper part and a lower part, wherein the upper part can be detachably axially connected by means of a rotary connection to the lower part in order to fix a carrier element between the upper part and the lower part, the rotary connection is formed by a stud provided on the lower part and an opening provided on the upper part, into which the stud can be screwed, and the rotary connection is implemented such that the rotary connection is released again after defined screwing of the stud into the opening such that the stud is locked in the opening with axial play.

According to the invention, the lower part has a disk-shaped attachment, whose layer thickness decreases toward the edge. The lower part thus has a tapered edge region at the lower end.

The decrease in the layer thickness of the disk-shaped attachment is achieved in the multi-part support element according to the invention in particular in that the top of the disk-shaped attachment is not a planar surface extending perpendicular to the stud.

In a preferred embodiment, the bottom of the disk-shaped attachment is substantially planar.

In another preferred embodiment, the top of the disk-shaped attachment is conical or substantially dome-shaped up to the stud.

In a particularly preferred embodiment, the bottom of the disk-shaped attachment is substantially planar and the top of the disk-shaped attachment is conical or substantially dome-shaped up to the stud.

The disk-shaped attachment is suitable for positive insertion into corresponding negative surface structures of the bore in a carrier element to be fixed between the lower part and the upper part of a support element according to the invention. The disk-shaped attachment can thus be countersunk in the carrier element to be fixed.

The disk-shaped attachment can have a recess on the underside, through which the lower part can be screwed into the upper part using a tool. The recess can, for example, be a hexagonal recess for a hex key or a slot for a screwdriver.

In the context of the present invention, "stud" means the element protruding from the lower part, which, due to its geometric shape, is suitable for insertion into a corresponding opening provided on the upper part to establish and subsequently to release a rotary connection.

According to the invention, "axial play" means that the stud can move freely in the axial direction within the opening over a certain length. Movement of the stud out of the opening in a direction opposite the insertion movement of the stud is in any case prevented by the locking action caused by the disengaged rotary connection.

In addition to preventing unwanted adhesion, the support element according to the invention makes it possible, in the stacked state of the kiln shelf, for no excessive forces, in particular not the entire weight force of the shelves, supports, and items to be fired arranged above the stud to be dissipated via the sensitive stud, since the studs are not rotationally connected to the opening surrounding them, but are guided therein with axial play, with the weight forces being dissipated via the support surfaces provided for this on the upper part and the lower part of the support element. Accordingly, the forces and, in particular, thermal and bending stresses occurring in the hot kiln atmosphere that cannot be absorbed by corresponding deformations with the use of high-strength and brittle ceramic materials can no longer have a destructive effect on the studs, making possible long service life of the support elements even under constantly changing mechanical and thermal stresses. And finally, the support element according to the invention is also simple in structure and can therefore be produced in high quantities at low cost. A support element according to the invention can, for example, be made of an injection molded ceramic upper part and an injection molded ceramic lower part.

Due to the fact that the disk-shaped attachment of the lower part is suitable for positive insertion into corresponding negative surface structures of the fastening bores of the carrier element to be fixed, i.e., can be countersunk in the carrier element to be fixed, the lower part of the support element according to the invention does not protrude out of the carrier element on the underside. Compared to support elements of the prior art, support elements according to the invention consequently offer, the advantage that the transport of carrier elements fixed with support elements according to the invention by roller conveyors is possible without problems.

In an embodiment of the support element according to the invention, the rotary connection is implemented as a screw connection, wherein the stud provided on the lower part has an external thread and the opening provided on the upper part has an internal thread. The external thread of the lower part and the internal thread of the upper part have the same dimension. Screw connections are technically easy to realize and can be established and released again without problems even with automated stacking and unstacking of kiln shelves. A screw connection as a rotary connection between the stud and the opening is, consequently, also particularly suitable, since the external thread provided on the stud and the internal thread provided in the opening can be arranged without design problems such that the rotary connection between the stud and the opening is first produced by screwing the stud into the opening; and by further screwing of the of the stud into the opening, the thread is released, thus locking the stud in the opening with axial play in the manner according to the invention. In terms of design, this can be facilitated by the fact that the stud has, viewed from its free end, an undercut behind the external thread, and the opening has, viewed from the bottom of the upper part, a corresponding undercut behind the internal thread. This makes axial guidance of the stud into the opening possible without any problems and without there being any unwanted friction of the stud, in particular of the internal thread, in the opening.

In an advantageous embodiment of the multi-part support element according to the invention, the stud has, in the region of the external thread on at least one side, a flattened region, which extends substantially parallel to the direction of extension of the stud. Preferably, the flattened region extends over the complete length of the external thread.

In another advantageous embodiment of the multi-part support element according to the invention, the stud has, in the region of the external thread on at least one side, a groove, which extends substantially parallel to the direction of extension of the stud. Preferably, the groove extends over the complete length of the external thread.

The presence of a flattened region or a groove in the region of the external thread on at least one side offers the advantage that dirt collects in the flattened region or the groove and thus does not stress the threads.

Preferably, the stud has, in the region of the external thread on two sides opposite one another, a flattened region or a groove, with the flattened region or the groove extending in each case substantially parallel to the direction of extension of the stud. The thread is, so to speak, divided into two sections between which is arranged, in each case, an area where no thread is arranged.

It goes without saying that the stud can also have a flattened region or a groove on more than two sides, with the flattened region or the groove extending in each case substantially parallel to the direction of extension of the stud. The thread can thus also be divided into more than two sections.

In an alternative embodiment, the rotary connection is implemented as a bayonet connection, wherein at least one protrusion that is provided on the stud engages in at least one slot-shaped guide provided in the opening of the upper part such that a plug-and-turn connection can be established, with the slot-shaped guide running such that upon insertion of the stud into the opening, the protrusion guided in the guide can exit this guide again to disengage the rotary connection after introduction of the stud into the opening such that the stud is subsequently locked in the opening with axial play. From a design standpoint, this can be facilitated in that the stud, viewed from its free end, has an undercut arranged behind the region in which the at least one protrusion is arranged, and the opening, viewed from the bottom of the upper part, has a corresponding undercut behind the region that has at least one slot-shaped guide. This makes axial guidance of the stud into the opening with axial play possible without any problems, without any unwanted friction of the stud, in particular of the at least one protrusion. The slot-shaped guide can run axially or inclined relative to the axial direction and, for example, can be formed by a kink or by a labyrinthine course. The plug-and-turn connection effectively prevents accidental detachment of the stud out of the opening.

In another embodiment of the support element according to the invention, the upper part has, at its lower axial end, a widened edge region with a seating surface, with which it rests on the carrier element which can be fixed between the upper part and the lower part of the support element. This ensures a particularly secure seating of the upper part on the carrier element fixed between the upper and the lower part, with the surface loading remaining within limits.

In an advantageous embodiment, the upper part has, on its bottom, a centering collar, with the centering collar arranged directly adjacent the opening. This centering collar is suitable for being arranged in a bore of a carrier element to be fixed between the lower part and the upper part of the support element. The centering collar prevents lateral displacement of the upper part.

Alternatively, lateral displacement of the upper part can also be prevented in that when implementing the rotary connection as a screw connection, the undercut of the upper part is dimensioned such that the external thread of the lower part rests substantially flush with the inner cylindrical surface of the upper part, or when implementing the rotary connection as a bayonet connection, the undercut of the upper part is dimensioned such that the at least one protrusion of the lower part rests substantially flush against the inner cylindrical surface of the upper part.

In an embodiment of the invention, the circular ring surface, which has a support element according to the invention of the top, is widened compared to the cylindrical middle section of the upper part.

In another embodiment of the invention, the support element includes, in addition to the upper part and the lower part, a tubular support that is pushed over the upper part. Preferably, the inner diameter of the tubular support essentially corresponds to the outer diameter of the upper part. The upper part is, consequently, a guide cylinder for the tubular support. The distance between the carrier elements of a kiln shelf can be determined by the length of the tubular support. This offers the advantage that the distance between the carrier elements of a kiln shelf can be changed without having to unscrew the support element in order to replace the upper part; instead, only the tubular support has to be replaced.

The invention also relates to a kiln shelf element at least comprising a carrier element with at least one bore and at least one multi-part support element according to the invention. The carrier element has a bottom and a top opposite the bottom, with the carrier element being fixed between the upper part and the lower part of the at least one multi-part support element. According to the invention, the bore is enlarged toward the bottom, in other words, the diameter of the bore increases from the top to the bottom. Preferably, the surface structures of the bore are designed negatively relative to the surface structure of the top of the disk-shaped attachment. The disk-shaped attachment of the lower part of the support element is, according to the invention, accommodated in the bore such that the support element does not protrude out of the carrier element at the bottom of the carrier element, in other words, the disk-shaped attachment is countersunk in the carrier element to be fixed.

The invention further relates to a kiln shelf with a lower carrier element and at least one upper carrier element, wherein the lower carrier element is fixed in at least one support element according to the invention and the at least one upper carrier element is fixed in at least one support element according to the invention between the upper part and the lower part, and the bottom of the lower part of the at least one support element that fixes the upper carrier element or the bottom of the upper carrier element rests on the upper part or the tubular support of the support element that fixes the lower carrier element.

Preferably, all carrier elements, i.e., the lower carrier element and one or more upper carrier elements arranged one above the other, are supported by at least one, preferably three or four multi-part support elements according to the invention. The carrier elements can in each case be disk-shaped or designed as plate setters.

FIG. 1 depicts a perspective view of an embodiment of an upper part 20 of a support element 10 according to the invention. The upper part 20 depicted in FIG. 1 is implemented as a hollow body. The through-opening 21 has an internal thread 22, i.e., an internal thread 22 is arranged in sections on the inner cylindrical surface 27 (not provided with a reference character in FIG. 1). In the embodiment depicted in FIG. 1, the internal thread 22 is not arranged directly adjacent the bottom 28 of the upper part 20. However, it is also possible for the internal thread 22 to be arranged directly adjacent the bottom 28. Viewed from the bottom 28 of the upper part 20, the opening 21 has, behind the internal thread 22, a region with an enlarged diameter (undercut) 23 (not shown in FIG. 1). In the embodiment depicted in FIG. 1, the upper part 20 has, at its lower end, a widened edge region 24 with a bottom seating surface 25, which is suitable for resting solidly on a shelf 40 to be fixed between an upper part 20 and a lower part 30. Finally, the upper part 20 also includes a top circular ring surface 26*a*, on which, in the assembled state of a kiln shelf, the lower part 30 of the next highest support element 10 can be arranged. In the embodiment depicted in FIG. 1, the circular ring surface 26*a* is widened at the top 26 of the upper part 20 compared to the cylindrical middle section of the upper part 20.

Figure 2:
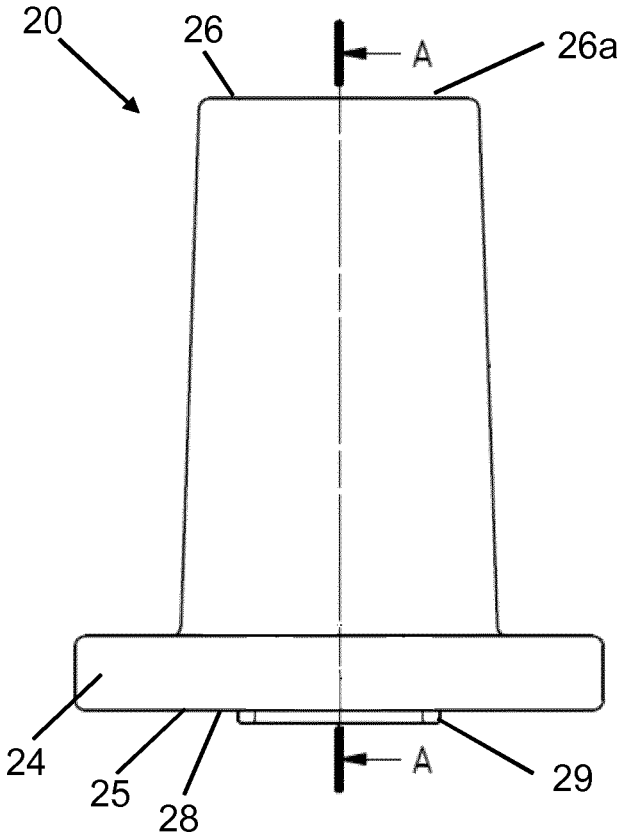

FIG. 2 depicts a side view of another embodiment of an upper part 20 of a support element 10 according to the invention. The embodiment depicted in FIG. 2 differs from the embodiment depicted in FIG. 1 in that the circular ring surface 26*a* at the top 26 of the upper part 20 is not widened compared to the cylindrical middle section of the upper part 20; and, in the widened edge region 24, the surface opposite the bottom seating surface 25 is implemented parallel to the seating surface 25. In addition, in the embodiment depicted, the upper part 20 has, on the bottom 28, a centering collar 29, which is arranged directly adjacent the opening 21. This centering collar 29 is suitable to be accommodated in the bore 41 of a shelf 40 to be fixed between the upper part 20 and the lower part 30 and thus to secure the upper part 20 against lateral slippage.

Figure 3:
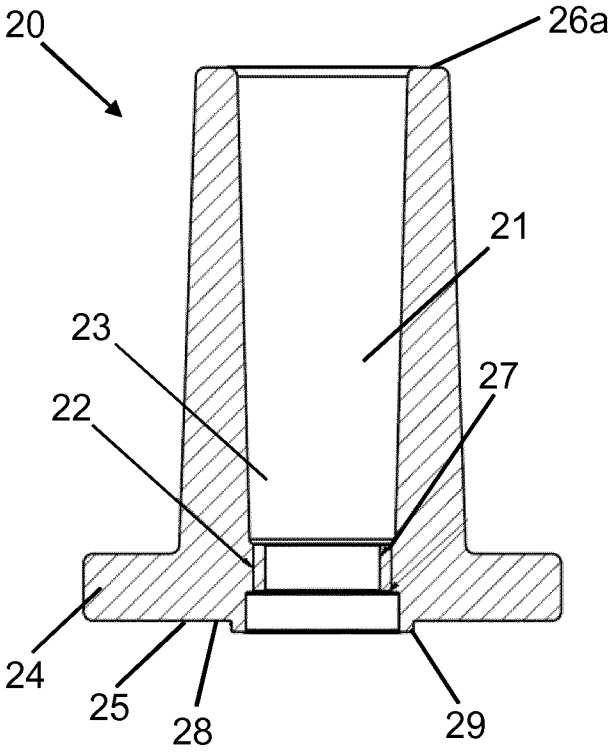

FIG. 3 depicts a cross-section of the upper part 20 of FIG. 2 along the section line A-A. It can be seen from FIG. 3 that the opening 21 has, viewed from the bottom 28 of the upper part 20, a region with an enlarged diameter (undercut) 23 behind the internal thread 22. In the embodiment depicted in FIG. 3, the internal thread 22 is not arranged directly adjacent the bottom 28 of the upper part 20. However, it is also possible for the internal thread 22 to be arranged directly adjacent the bottom 28.

Figure 4:
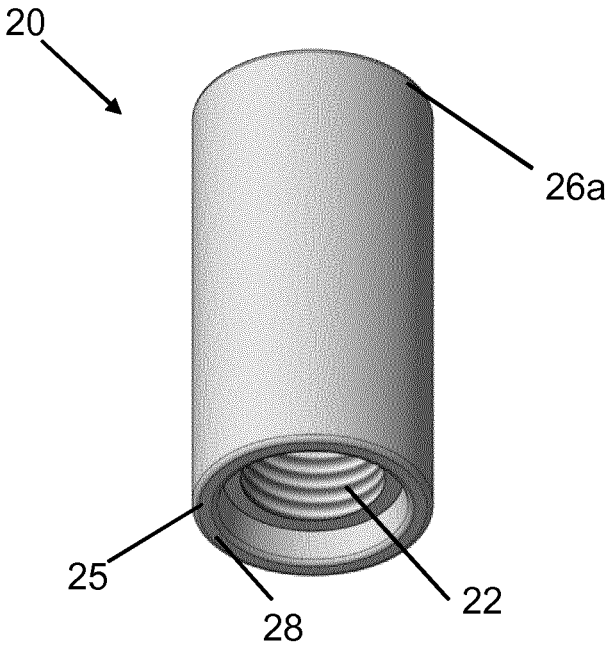

FIG. 4 depicts a perspective view of another embodiment of an upper part 20 of a support element 10 according to the invention. This embodiment differs from the embodiment depicted in FIG. 1 in that the circular ring surface 26 at the top 26*a* of the upper part 20 is not widened compared to the cylindrical middle section of the upper part 20 and the upper part 20 also does not have a widened edge region 24 on the bottom 28.

Figure 5:
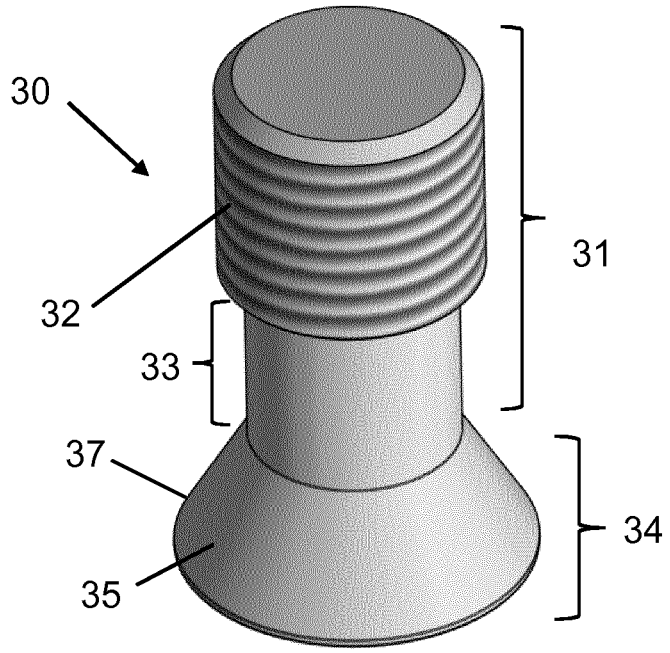

FIG. 5 depicts a perspective view of an embodiment of a lower part 30 of a support element 10 according to the invention. The lower part 30 comprises a centrally arranged stud 31 and a disk-shaped attachment 34, whose layer thickness decreases toward the edge. In the embodiment depicted in FIG. 5, the bottom 36 of the disk-shaped attachment is planar and its top 37 is conical up to the stud 31. The stud 31 has an external thread 32 directly adjacent its free end. The external thread 32 is implemented such that it can be screwed into the internal thread 22 of the upper part 20 depicted in FIG. 1 through 4. Below the external thread 32, the stud 31 has an undercut 33 with a reduced diameter compared to the thread core.

Figure 6:
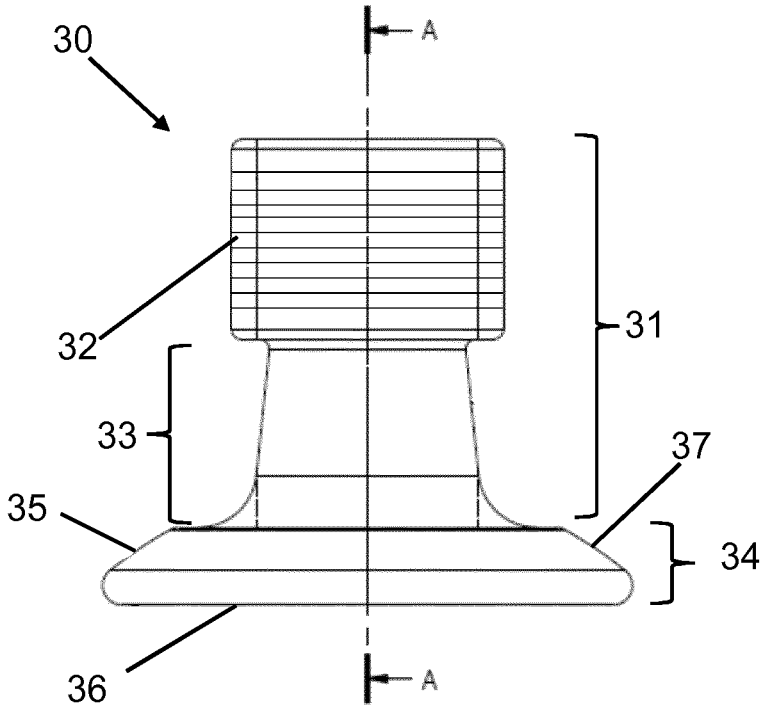

FIG. 6 depicts a side view of another embodiment of a lower part 30 of a support element 10 according to the invention. The lower part 30 depicted in FIG. 6 essentially corresponds to the lower part 30 depicted in FIG. 5 such that in the following only the differences are discussed.

In the embodiment depicted in FIG. 5, the bottom 36 of the disk-shaped attachment is planar and its top 37 is essentially dome-shaped up to the stud 31.

Figure 7:
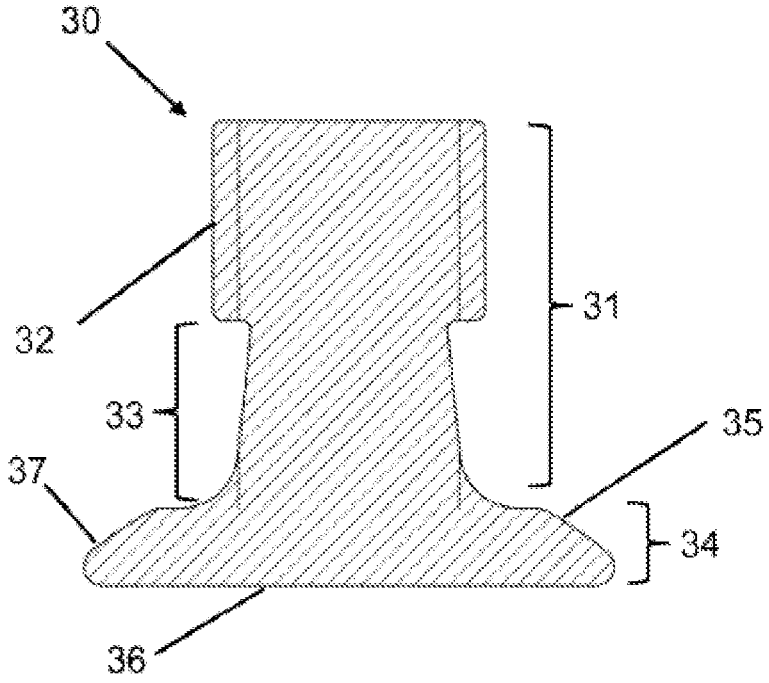

FIG. 7 depicts a cross-section of the lower part of FIG. 6 along the section line A-A.

Figure 8:
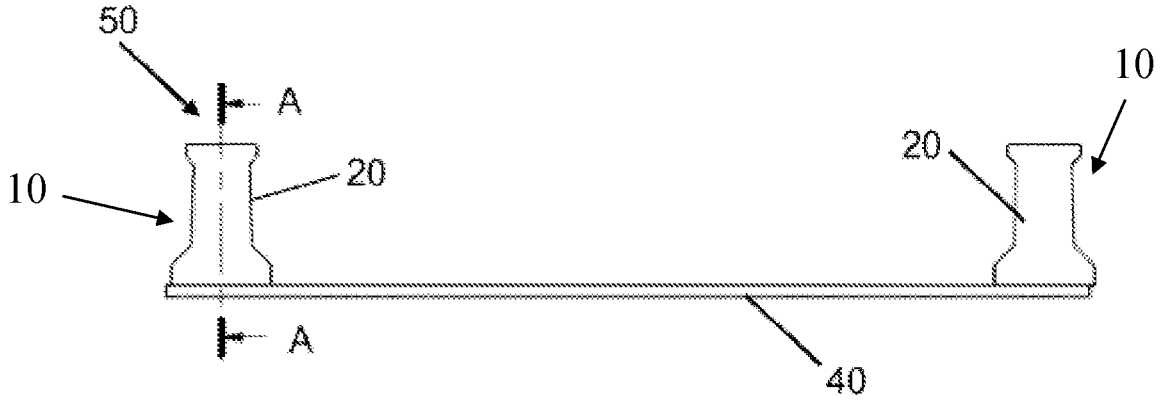

FIG. 8 depicts a side view of an embodiment of a kiln shelf element 50 according to the invention. The kiln shelf element 50 comprises a carrier element 40 and two support elements 10 according to the invention, with only the upper parts 20 of the support elements visible, since the lower parts 30 are completely covered by the upper parts 20 and the carrier element 40. The upper parts 20 are implemented like the upper part 20 depicted in FIG. 1.

Figure 9:
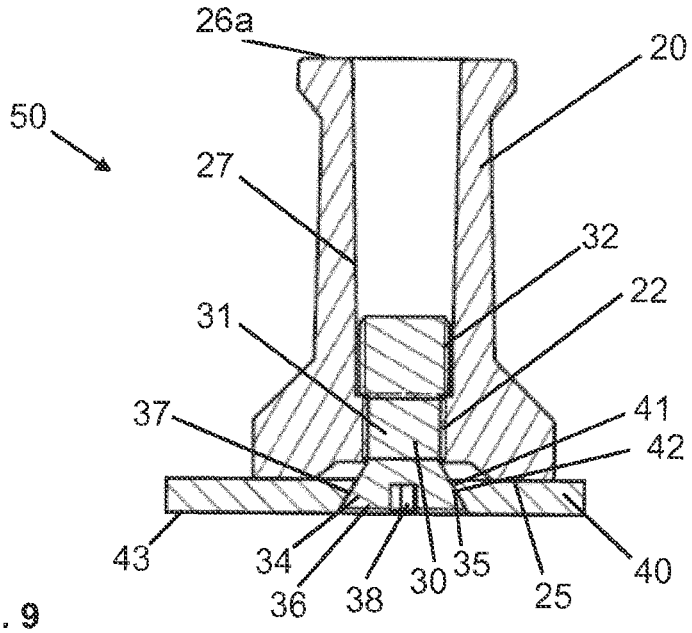

FIG. 9 depicts a detail of a cross-section of an embodiment of the kiln shelf element 50 according to the invention of FIG. 8 along the section line A-A. The detail depicts the cross-section through an upper part 20, a lower part 30, and a carrier element 40 fixed therebetween. The upper part 20 is an upper part 20 as depicted in FIG. 1, and the lower part 30 is a lower part 30 as depicted in FIG. 5. The carrier element 40 fixed between the lower part 30 and the upper part 20 has a bore 41 that is widened toward the bottom 43 of the carrier element 40. The bore widening 42 corresponds to a negative surface structure analogous to the conical top 37 of the disk-shaped attachment 34. The disk-shaped attachment 34 of the lower part 30 is, in sections, accommodated essentially flush in the bore widening 42 of the carrier element 40, i.e., it is countersunk in the carrier element 40, and the bottom 36 of the lower part 30 does not protrude from the bore 41 at the bottom 43 of the carrier element 40. In the embodiment depicted in FIG. 9, the disk-shaped attachment 34 has a hexagonal recess 38 for a hex key.

Both the upper part 20 and the lower part 30 of the support element 10 as well as the carrier element 40, implemented here as a simple firing batt, are made of highly temperature resistant but also brittle ceramic material, such as silicon carbide or mullite. As can be seen in FIG. 9, the stud 31 of the lower part 30 is locked in the opening 21 of the upper part 20 with axial play in accordance with the invention such that weight forces caused on the upper part 20 by additional carrier elements 40, support elements 10, and items to be fired (not shown) resting thereon do not stress the stud 31, but are instead dissipated via the surfaces 26*a*, 25, 35, and 36 of the upper part 20 and of the lower part 30 of the support element 10 provided for this.

Figure 10:
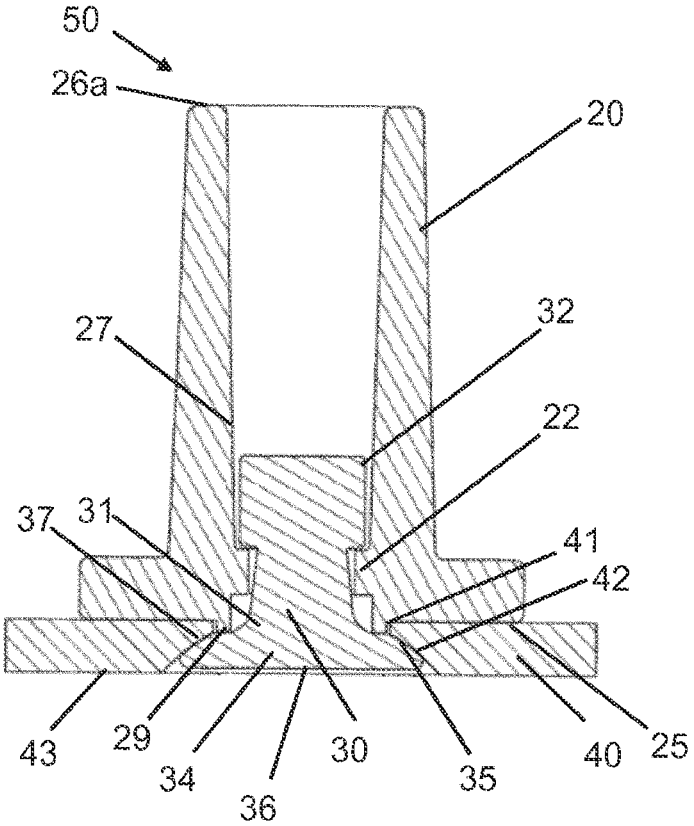

FIG. 10 depicts a detail of a cross-section of another embodiment of a kiln shelf element 50 according to the invention. The detail depicts the cross-section through an upper part 20, a lower part 30, and a carrier element 40 fixed therebetween. The upper part 20 is an upper part 20 as depicted in FIGS. 2 and 3, and the lower part 30 is a lower part 30 as depicted in FIGS. 6 and 7. The carrier element 40 fixed between the lower part 30 and the upper part 20 has a bore 41 that is widened towards the bottom 43 of the carrier element 40. The bore widening 42 corresponds to a negative surface structure analogous to the substantially dome-shaped top 37 of the disk-shaped attachment 34. The disk-shaped attachment 34 of the lower part 30 is, in sections, accommodated essentially flush in the bore widening 42 of the carrier element 40, i.e., it is countersunk in the carrier element 40, and the bottom 36 of the lower part 30 does not protrude from the bore 41 at the bottom 43 of the carrier element 40. The top 37 thus represents the support surface 35 for the carrier element 40 to be fixed. It can also be seen from FIG. 10 that the centering collar 29 of the upper part 20 is accommodated in the bore 41 of the carrier element 40 such that lateral slippage of the upper part 20 is prevented.

Both the upper part 20 and the lower part 30 of the support element 10 as well as the carrier element 40, implemented here as a simple firing batt, are made of highly temperature-resistant but also brittle ceramic material, such as silicon carbide or mullite. As can be seen in FIG. 10, the stud 31 of the lower part 30 is locked in the opening 21 of the upper part 20 with axial play in accordance with the invention such that weight forces caused on the upper part 20 by an additional carrier element 40, support element 10, and items to be fired (not shown) resting thereon do not stress the stud 31, but are instead dissipated via the surfaces 26*a*, 25, 35, and 36 of the upper part 20 and of the lower part 30 of the support element 10 provided for this.

Figure 11:
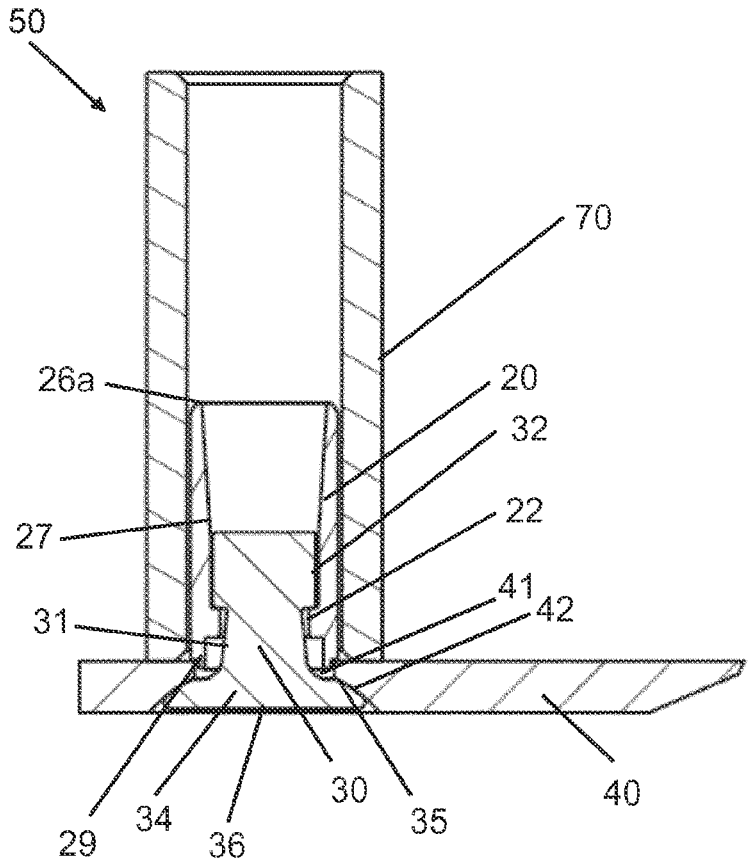

FIG. 11 depicts a detail of a cross-section of another embodiment of a kiln shelf element 50 according to the invention. The kiln shelf element 50, whose cross-section is depicted in detail in FIG. 11, differs from the kiln shelf element 50, whose cross-section is depicted in detail in FIG. 10, only in that the upper part 20 is the upper part 20 depicted in FIG. 4 and the kiln shelf element 50 additionally includes a tubular support 70, which is pushed over the upper part 20 and protrudes beyond the upper part 20. The inner diameter of the tubular support 70 essentially corresponds to the outer diameter of the upper part 20.

Figure 12:
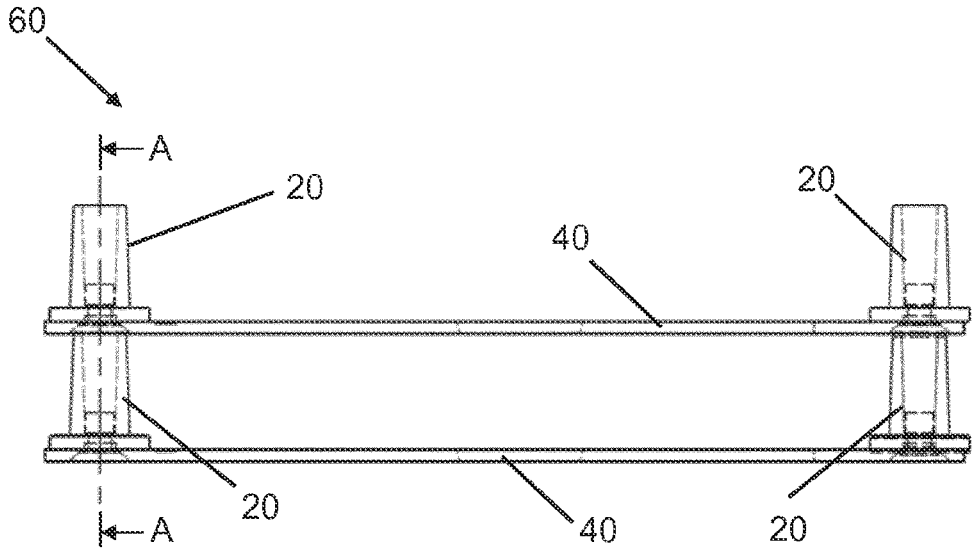

FIG. 12 depicts a side view of an embodiment of a kiln shelf 60 according to the invention. The kiln shelf 60 comprises two carrier elements 40, fixed in each case between the upper part 20 and the lower part 30 by two support elements 10. The upper parts 20 are upper parts 20 in accordance with the embodiment depicted in FIGS. 2 and 3. The lower parts 30 are implemented like the lower parts 30 in FIG. 6. The kiln shell 60 depicted in FIG. 12 thus includes two kiln shelf elements 50, as depicted in detail in the cross-section in FIG. 10.

Figure 13:
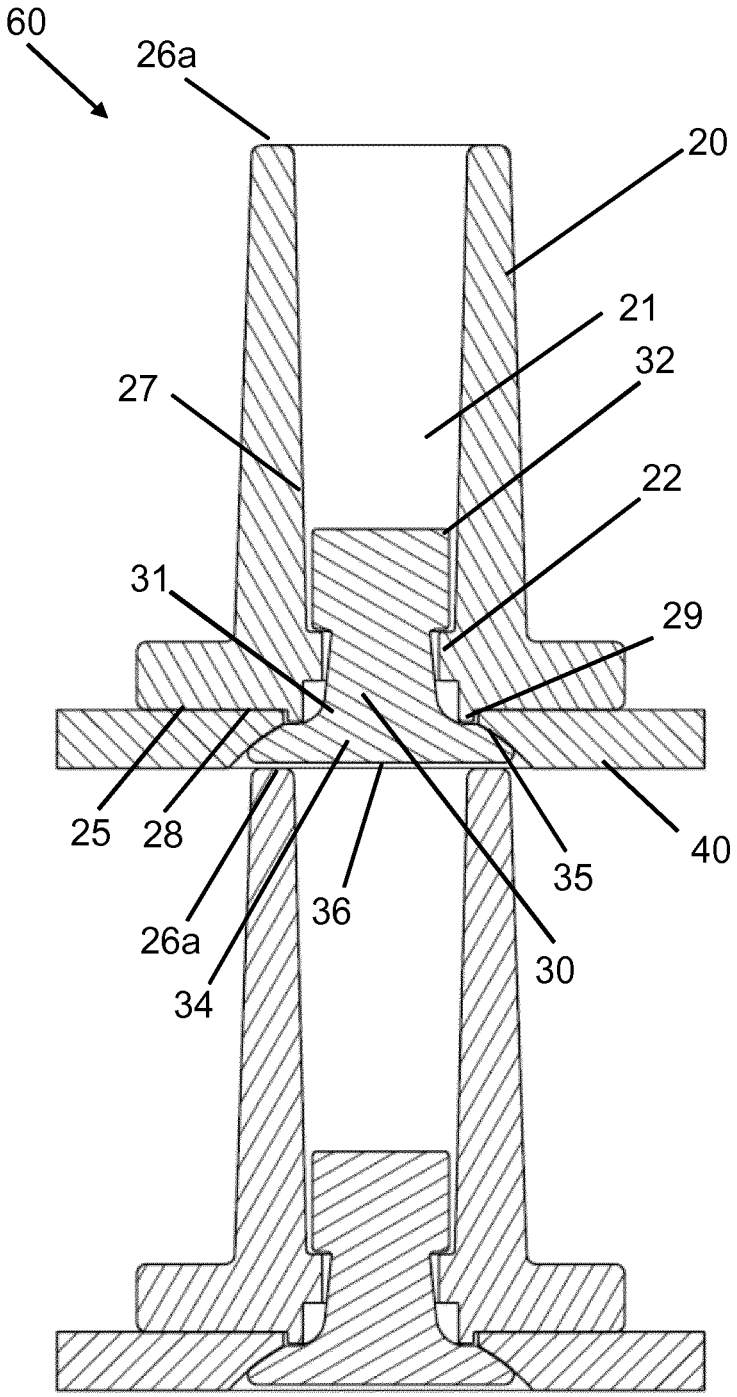

FIG. 13 depicts a cross-section of a detail of the kiln shelf 60 of FIG. 12 along the section line A-A. As can be seen in FIG. 13, in the case of each of the support elements 10, the stud 31 of the lower part 30 is locked in the opening 21 of the upper part 20 with axial play in accordance with the invention such that weight forces caused on the upper part 20 by additional carrier elements 40, support elements 10, and items to be fired (not shown) resting thereon do not stress the stud 31, but are instead dissipated via the surfaces 26*a*, 25, 35, and 36 of the upper part 20 and of the lower part 30 of the support element 10 provided for this. The bottom 36 of the lower part 30, which fixes the upper carrier element 40, rests, in the embodiment depicted in FIG. 13, on the circular ring surface 26*a* of the upper part 20, which fixes the lower carrier element 40.

Figure 14:
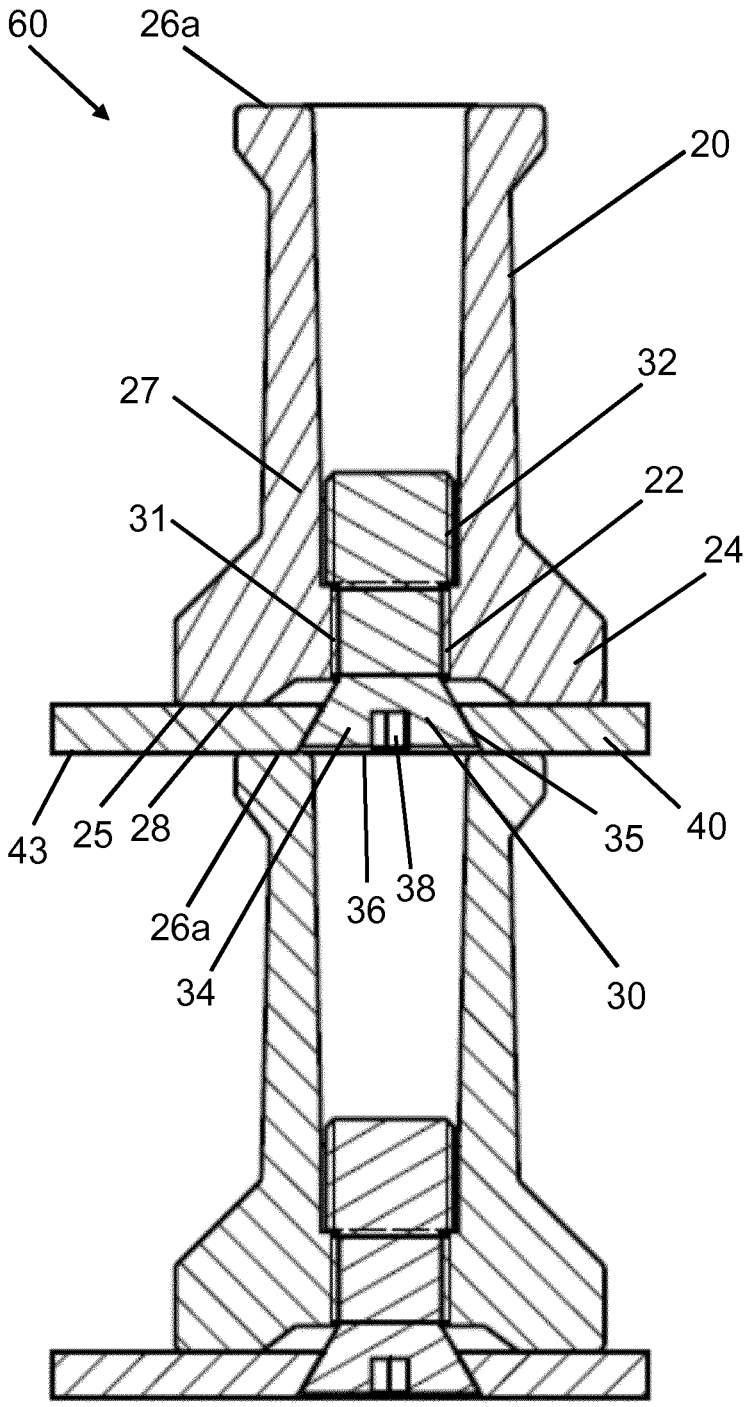

FIG. 14 depicts the cross-section of a detail of another embodiment of a kiln shelf 60. The kiln shelf 60 comprises two carrier elements 40, fixed in each case between the upper part 20 and the lower part 30 by a support element 10. The upper parts 20 are upper parts 20 in accordance with the embodiment depicted in FIG. 1. The lower parts 30 are implemented like the lower parts 30 in FIG. 5. The kiln shelf 60 depicted in FIG. 14 thus includes two kiln shelf elements 50, as depicted in detail in cross-section in FIG. 9. As can be seen in FIG. 14, in the case of each of the support elements 10, the stud 31 of the lower part 30 is locked in the opening 21 of the upper part 20 with axial play in accordance with the invention such that weight forces caused on the upper part 20 by additional carrier elements 40, support elements 10, and items to be fired (not shown) do not stress the stud 31, but are instead dissipated via the surfaces 26*a*, 25, 35, and 36 of the upper part 20 and of the lower part 30 of the support element 10 provided for this. The bottom 43 of the upper carrier element 40 rests, in the embodiment depicted in FIG. 14, in sections, on the circular ring surface 26*a* of the upper part 20, which fixes the lower carrier element 40. Alternatively, however, it is also possible to dimension the lower part 30 and the bore 41 with the bore widening 42 such that the bottom 36 of the lower part 30, which fixes the upper carrier element 40, rests on the circular ring surface 26*a* of the upper part 20, which fixes the lower carrier element 40.

Figure 15:
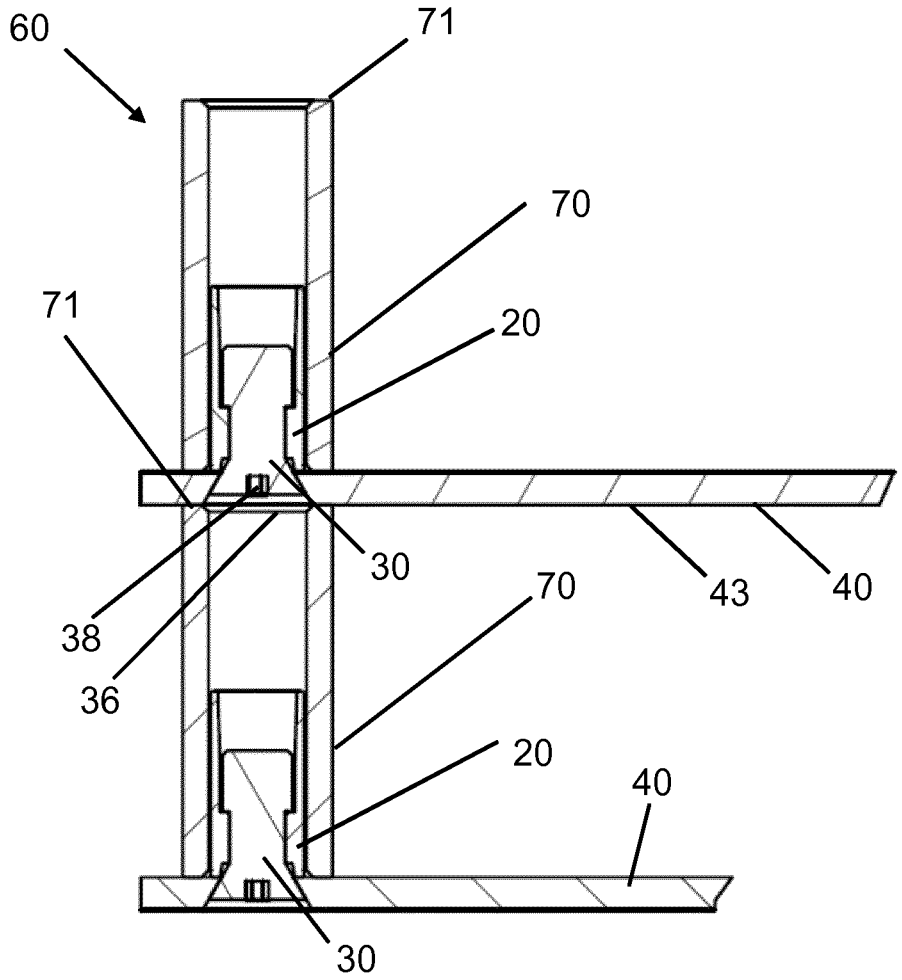

FIG. 15 depicts the cross-section of a detail of another embodiment of a kiln shelf 60. The kiln shelf 60 comprises two carrier elements 40, fixed in each case between the upper part 20 and the lower part 30 by a support element 10. The upper parts 20 are upper parts 20 in accordance with the embodiment depicted in FIG. 4. The lower parts 30 are implemented like the lower part 30 in FIG. 5. The disk-shaped attachment 34 has a hexagonal recess 38 for a hex key. A tubular support 70 is pushed in each case over the upper parts 20. As can be seen in FIG. 15, in the case of each of the support elements 10, the stud 31 of the lower part 30 is locked in the opening 21 of the upper part 20 with axial play in accordance with the invention such that weight forces caused on the upper part 20 by additional carrier elements 40, support elements 10, and items to be fired (not shown) do not stress the stud 31, but are instead dissipated via the surfaces 71, 25, 35, and 36 of the tubular support 71 and of the upper part 20 and of the lower part 30 of the support element 10 provided for this. The inner diameters of the tubular supports 70 essentially corresponds to the outer diameters of the upper parts 20. The bottom 43 of the upper carrier element 40 rests, in the embodiment depicted in FIG. 15, in sections on the circular ring surface 71 of the tubular support 70, which is pushed over the upper part 20, which fixes the lower carrier element 40. Alternatively, however, it is also possible to dimension the lower part 30 and the bore 41 with the bore widening 42 such that the bottom 36 of the lower part 30, which fixes the upper carrier element 40, rests on the circular ring surface 71 of the tubular support 70, which is pushed over the upper part 20, which fixes the lower carrier element 40.

Figure 16:
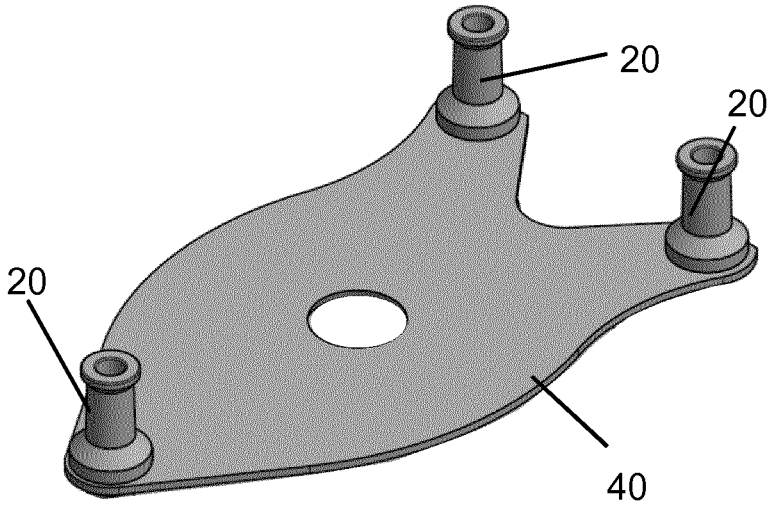

FIG. 16 depicts a perspective view of an embodiment of a kiln shelf element 50 according to the invention. In this embodiment, the kiln shelf element 50 comprises a carrier element 40, that is fixed between the upper parts 20 and the lower parts 30 by three support elements 10. The upper parts 20 are implemented as depicted in the embodiment of FIG. 1.

Figure 17:
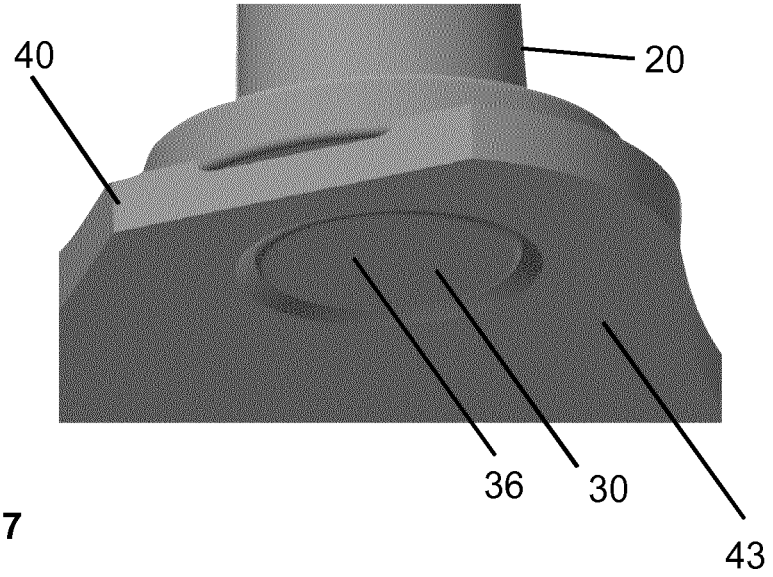

FIG. 17 depicts a perspective bottom view of a detail of the kiln shelf element of FIG. 16. It can be seen in FIG. 17 that the bottom 36 of the lower part 30 does not protrude from the carrier element 40 at the bottom 43 of the carrier element 40.

Figure 18:
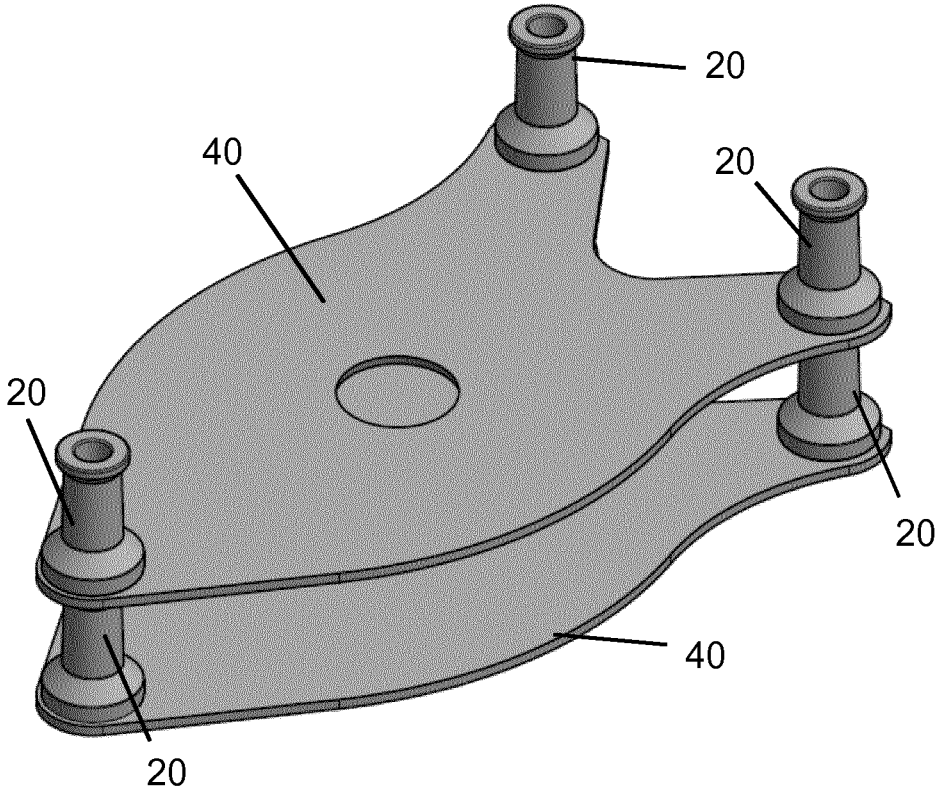

FIG. 18 depicts a perspective view of an embodiment of a kiln shelf 60 according to the invention. The kiln shelf 60 depicted comprises two kiln shelf elements 50 arranged one above the other in accordance with the embodiment depicted in FIG. 16.

Figure 19:
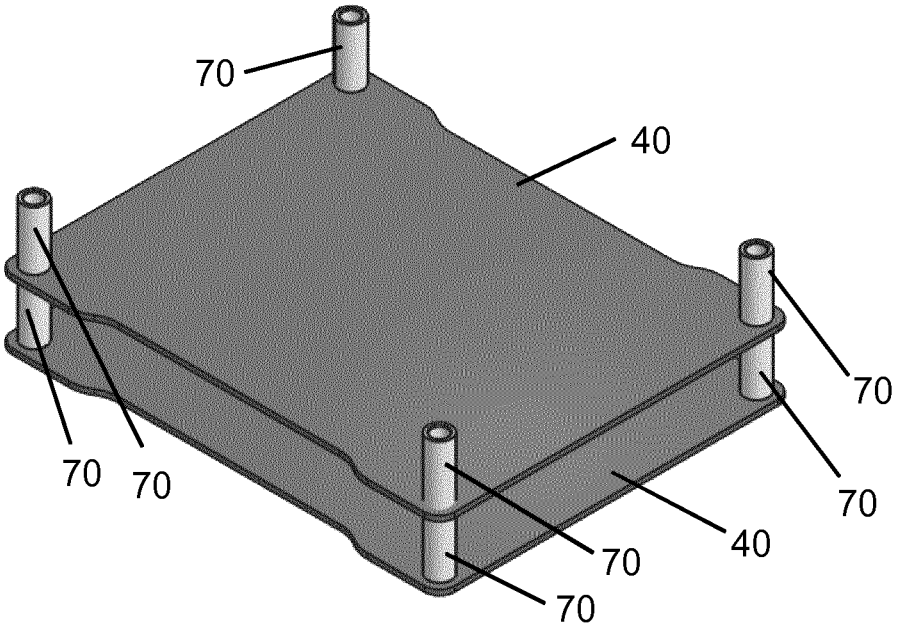

FIG. 19 depicts a perspective view of another embodiment of a kiln shelf 60 according to the invention. The kiln shelf 60 depicted comprises two carrier elements 40, which are in each case fixed in four support elements 10, with the support elements 10 comprising in each case an upper part 20 in accordance with the embodiment depicted in FIG. 4 with a tubular support 70 pushed over it and a lower part 30 in accordance with the embodiment depicted in FIG. 5.

Figure 20:
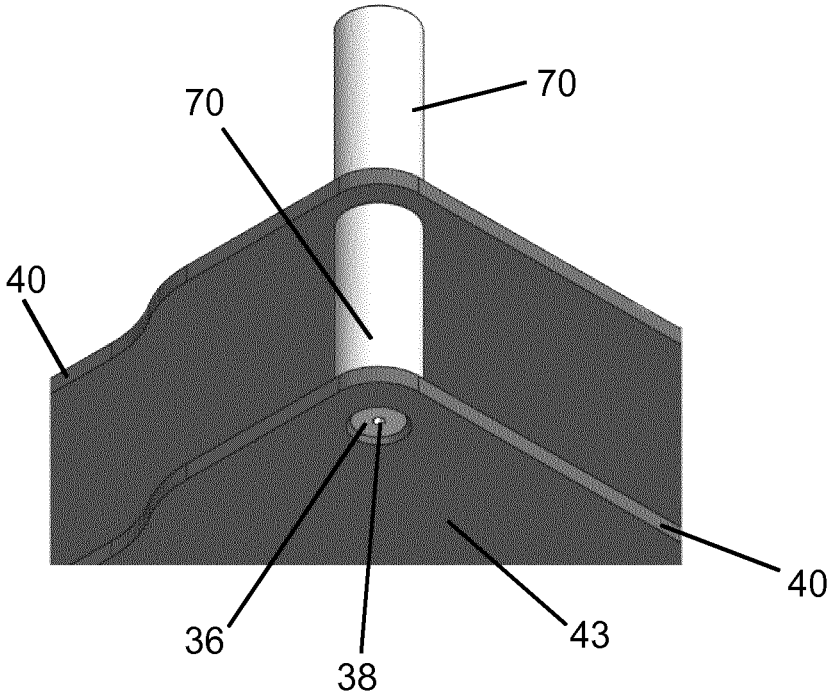

FIG. 20 depicts a perspective bottom view of a detail of the kiln shelf of FIG. 19. It can be seen from FIG. 20 that the bottom 36 of the lower part 30 does not protrude from the carrier element 40 at the bottom 43 of the carrier element 40. In addition, it is discernible in FIG. 20 that the lower part 30 has a hexagonal recess 38 for a hex key on the bottom 36.

When assembling a kiln shelf composed of support elements 10 and carrier elements 40 according to the invention, as depicted, for example, in FIG. 18, the upper part 20 and the lower part 30 of each support element 10 are preferably connected to one another as follows:

First, the upper part 20 is placed on the shelf 40 to be fixed between the upper part 20 and the lower part 30 such that the bottom opening 21 of the upper part 20 is aligned with a corresponding bore 41 in the carrier element 40. Then, the lower part 30 of the support element 10 is guided through the bore 41 and screwed with its external thread 32 into the corresponding internal thread 22 in the opening 21 of the upper part 20, establishing a rotary connection between the upper part 20 and the lower part 30. The screwing can be done manually or by machine. According to the invention, the stud 31 is now screwed further into the opening 21 of the upper part 20, until the rotary connection is released, such that the stud 31 can no longer be pulled downward out of the opening 21, is thus locked therein, and is, at the same time, locked with axial play in the opening 21. The upper part 20, the lower part 30, and the bore 41, together with the bore widening 42 of the carrier element 40, are dimensioned such that when the rotary connection is again released, the disk-shaped attachment 34 of the lower part is accommodated in the bore widening 41 essentially flush such that the bottom 36 of the lower part 30 does not protrude from the bottom 43 of the carrier element 40.

When assembling a kiln shelf as depicted in FIG. 19, a tubular support is pushed over the upper part of each support element after the steps described above.

Figure 21:
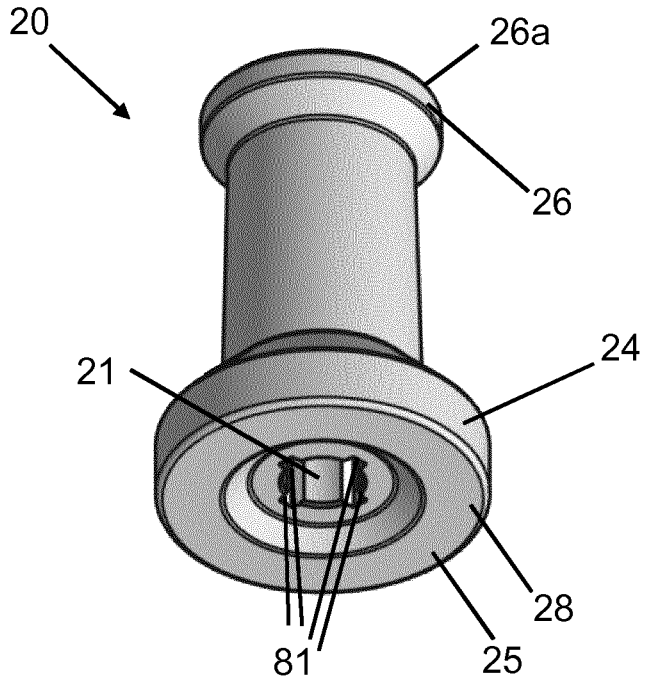

FIG. 21 depicts a perspective view of an embodiment of an upper part 20 of a support element 10 according to the invention. The upper part 20 depicted in FIG. 21 is implemented as a hollow body. In this embodiment, the through-opening 21 has four slot-shaped guides 81. In the embodiment depicted in FIG. 21, the section with the four slot-shaped guides 81 is not arranged directly adjacent the bottom 28 of the upper part 20. However, it is also possible for it to be arranged directly adjacent the bottom 28. Viewed from the bottom 28 of the upper part 20, the opening 21 has, behind the section with the four slot-shaped guides 81, a region with an enlarged diameter (undercut) 23 (not shown in FIG. 21). In the embodiment depicted in FIG. 21, the upper part 20 has, at its lower end, a widened edge region 24 with a bottom seating surface 25, which is suitable for resting solidly on a shelf 40 to be fixed between an upper part 20 and a einem part 30. Finally, the upper part 20 also includes a top circular ring surface **26*a*, on which, in the assembled state of a kiln shelf, the lower part 30 of the next higher support element 10 can be arranged. In the embodiment depicted in FIG. 21, the circular ring surface 26*a* is widened at the top 26 of the upper part 20 compared to the cylindrical middle section of the upper part 20**.

Figure 22:
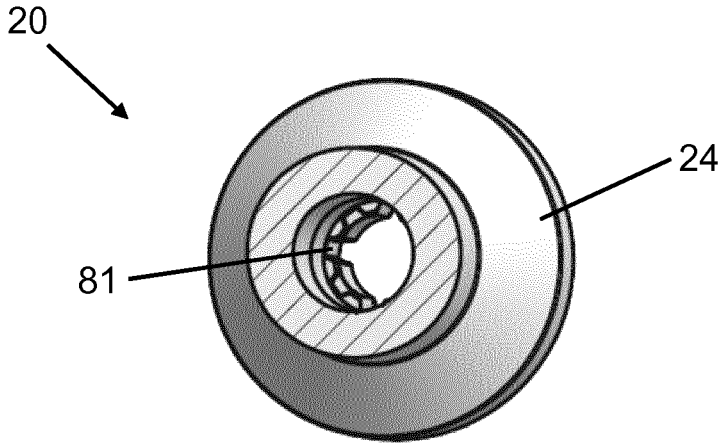

FIG. 22 depicts a perspective view of a detail of the upper part of FIG. 21.

Figure 23:
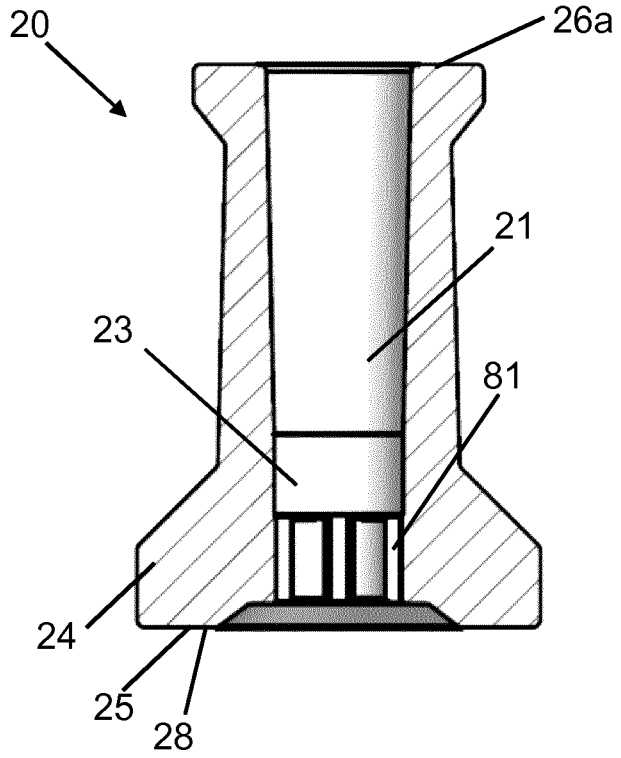

FIG. 23 depicts a cross-section of the upper part 20 of FIG. 21 along a central section line from the top 26 to the bottom 28. It can be seen from FIG. 23 that the opening 21 has, viewed from the bottom 28 of the upper part 20, a region with an enlarged diameter (undercut) 23 behind the section with the four slot-shaped guides 81. In the embodiment depicted in FIG. 23, the section with the four slot-shaped guides 81 is not arranged directly adjacent the bottom 28 of the upper part 20. However, it is also possible for it to be arranged directly adjacent the bottom 28.

Figure 24:
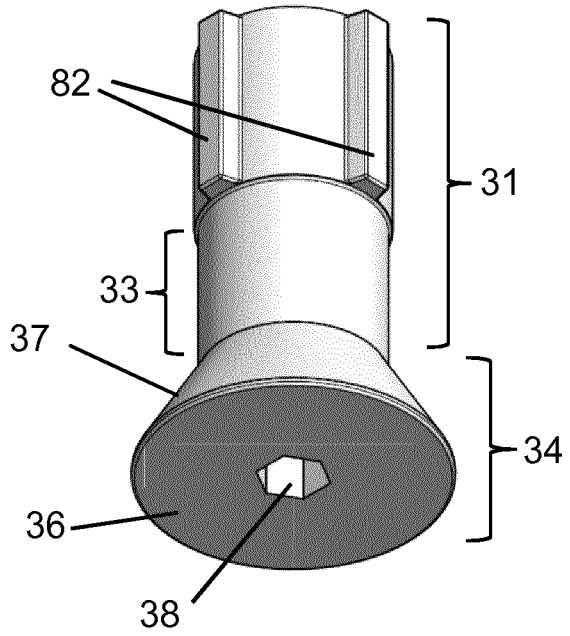

FIG. 24 depicts a perspective view of an embodiment of a lower part 30 of a support element 10 according to the invention. The lower part 30 comprises a centrally arranged stud 31 and a disk-shaped attachment 34, whose layer thickness decreases toward the edge. In the embodiment depicted in FIG. 24, the bottom 36 of the disk-shaped attachment is planar and its top 37 is conical up to the stud 31. The stud 31 has protrusions 82 directly adjacent its free end. The protrusions 82 are implemented such that they can be inserted into the slot-shaped guides 81 of the upper part 20 depicted in FIG. 21 through 23. Below the section with the protrusions 82, the stud 31 has an undercut 33 with a reduced diameter compared to the section with the protrusions 82. In addition, it can be discerned in FIG. 24 that in the embodiment depicted in FIG. 24, the lower part 30 has a hexagonal recess 38 for a hex key on the bottom 36.

Figure 25:
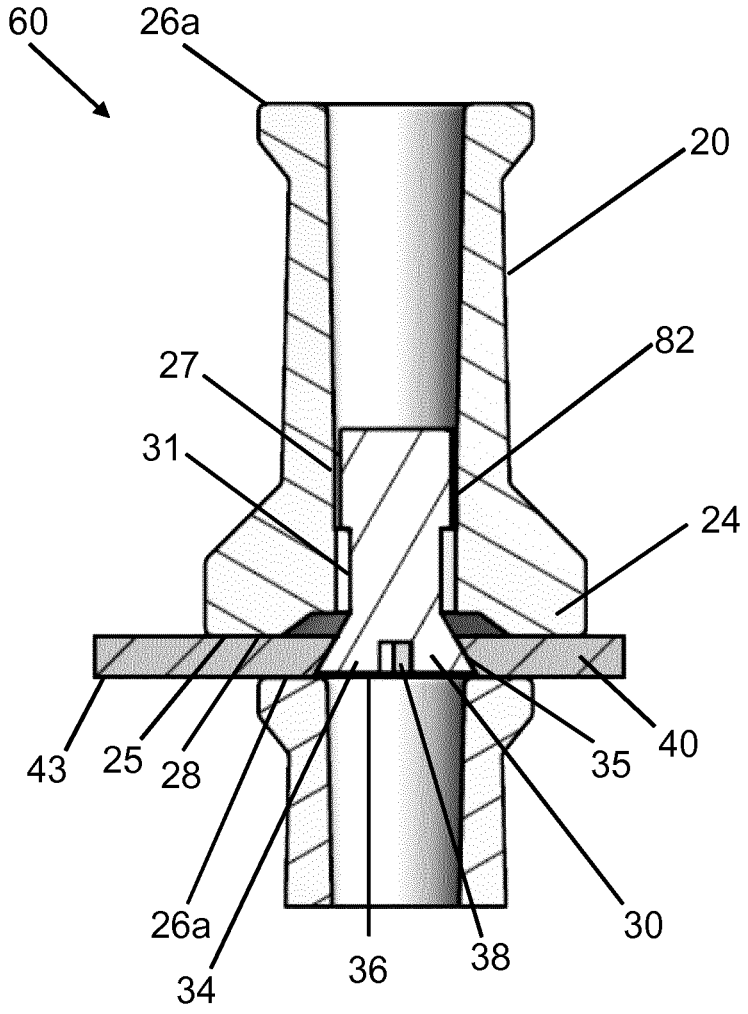

FIG. 25 depicts the cross-section of a detail of an embodiment of a kiln shelf 60. The kiln shelf 60, of which the cross-section of a detail is depicted in the figure, comprises two carrier elements 40, fixed in each case between the upper part 20 and the lower part 30 by a support element 10. The upper parts 20 are upper parts 20 in accordance with the embodiment depicted in FIG. 21 through 23. The lower parts 30 are implemented like the lower part 30 in FIG. 24. The carrier element 40 fixed between the lower part 30 and the upper part 20 has a bore 41 that is widened toward the bottom 43 of the carrier element 40. The bore widening 42 corresponds to a negative surface structure analogous to the conical top 37 of the disk-shaped attachment 34. The disk-shaped attachment 34 of the lower part 30 is, in sections, accommodated essentially flush in the bore widening 42 of the carrier element 40, i.e., it is countersunk in the carrier element 40, and the bottom 36 of the lower part 30 does not protrude from the bore 41 at the bottom 43 of the carrier element 40. In the embodiment depicted in FIG. 25, the disk-shaped attachment 34 has a hexagonal recess for a hex key. As can be seen in FIG. 25, with each of the support elements 10, the stud 31 of the lower part 30 is locked in the opening 21 of the upper part 20 with axial play in accordance with the invention such that weight forces caused on the upper part 20 by additional carrier elements 40, support elements 10, and items to be fired (not shown) do not stress the stud 31, but are instead dissipated via the surfaces 26*a*, 25, 35, and 36 of the upper part 20 and of the lower part 30 of the support element 10. The bottom 43 of the upper carrier element 40, rests, in the embodiment depicted in FIG. 25, in sections, on the circular ring surface 26*a* of the upper part 20, which fixes the lower carrier element 40 (outside the detail depicted in FIG. 25). Alternatively, however, it is also possible to dimension the lower part 30 and the bore 41 with the bore widening 42 such that the bottom 36 of the lower part 30, which fixes the upper carrier element 40, rests on the circular ring surface 26*a* of the upper part 20, which fixes the lower carrier element 40.

Figure 26:
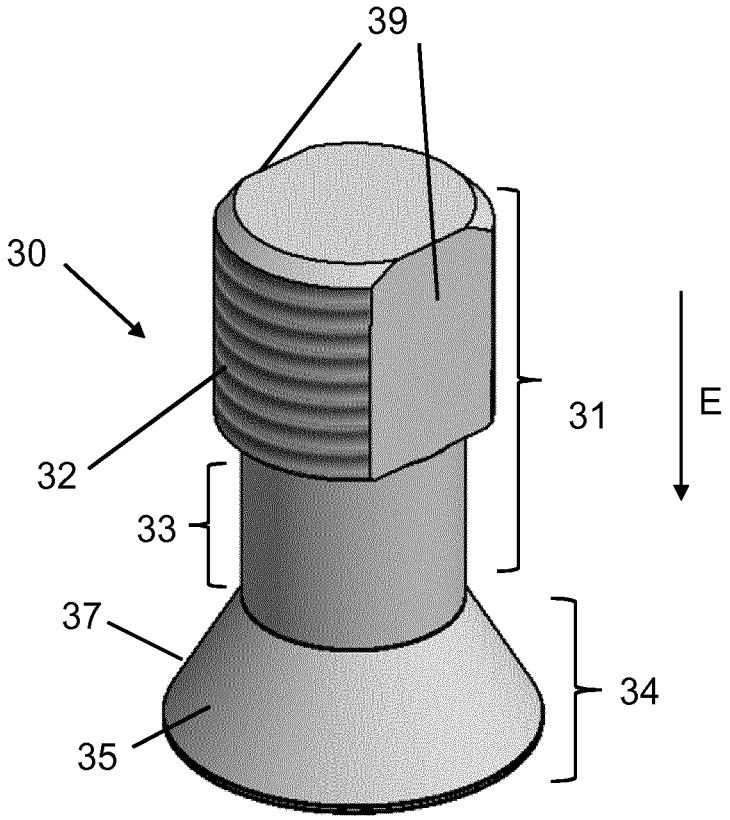

FIG. 26 depicts a perspective view of another embodiment of a lower part 30 of a support element 10 according to the invention. The embodiment depicted in FIG. 26 differs from the embodiment of a lower part depicted in FIG. 5 only in that the stud 31 has a flattened region 39 in the region of the external thread 32 on two sides opposite one another. The thread is, so to speak, cut off in this region. The flattened regions 39 extend parallel to the direction of extension E of the stud 31 and extend over the complete length of the external thread 32 in the embodiment depicted in FIG. 26.

LIST OF REFERENCE CHARACTERS

10 multi-part support element
20 upper part
21 opening
22 internal thread
23 undercut, region with an enlarged diameter
24 widened edge region
25 seating surface
26 top
26*a* circular ring surface
27 internal cylindrical surface
28 bottom
29 centering collar
30 lower part
31 stud
32 external thread
33 undercut, region with reduced diameter
34 disk-shaped attachment
35 support surface
36 bottom
37 top
38 recess
39 flattened region
40 carrier element
41 bore
42 bore widening
43 bottom of the carrier element
50 kiln shelf element
60 kiln shelf
70 tubular support
71 circular ring surface of the tubular support
81 slot-shaped guide
82 protrusion
E direction of extension

The invention claimed is:

1. A multi-part support element for spacing carrier elements, comprising an upper part and a lower part, wherein the upper part is configured to be detachably axially connected to the lower part by a rotary connection in order to fix a carrier element between the upper part and the lower part, the rotary connection is formed by a stud provided on the lower part and an opening provided on the upper part, into which the stud is to be screwed, and the rotary connection is implemented such that the rotary connection is released again after defined screwing of the stud into the opening, such that the stud is locked in the opening with axial play, wherein the lower part has a disk-shaped attachment, whose layer thickness decreases toward the edge, wherein (i) the rotary connection is implemented as a screw connection, the stud provided on the lower part has an external thread, and the opening provided on the upper part has an internal thread, and (i-1) wherein the stud has a flattened region or a groove in the region of the external thread, on at least one side and the flattened region or the groove extends substantially parallel to the direction of extension of the stud, and wherein the flattened region or the groove extends over the complete length of the external thread, or (i-2) the stud, viewed from its free end, has an undercut behind the external thread, and the opening, viewed from the bottom of the upper part, has a corresponding undercut behind the internal thread, or (ii) the rotary connection is implemented as a bayonet connection, and at least one protrusion, which is provided on the stud, engages in at least one slot-shaped guide provided in the opening of the upper part such that a plug-and-turn connection can be established, wherein the slot-shaped guide-extends in such a way that upon insertion of the stud into the opening, the protrusion guided in the slot-shaped guide can exit said guide to disengage the rotary connection after insertion of the stud into the opening such that the stud is subsequently locked in the opening with axial play.

2. The multi-part support element according to claim 1, wherein a top of the disk-shaped attachment is conical or substantially dome-shaped up to the stud.

3. The multi-part support element according to claim 1, wherein a bottom of the disk-shaped attachment is substantially planar.

4. The multi-part support element according to claim 1, wherein the upper part has, at its lower axial end, a widened edge region with a seating surface, with which it rests on a carrier element fixable between the upper part and the lower part of the support element.

5. The multi-part support element according to claim 1, wherein the upper part has a centering collar on its bottom directly adjacent the opening.

6. The multi-part support element according to claim 1, additionally comprising a tubular support, wherein the tubular support is pushed over the upper part.

7. The multi-part support element according to claim 1, wherein the stud has a flattened region or a groove in the region of the external thread, on two sides opposite one another.

8. A kiln shelf element, comprising:

a carrier element having a bottom, a top opposite the bottom, and at least one bore, wherein the bore is enlarged toward the bottom; and at least one multi-part support element for spacing the carrier element, the at least one multi-part support element comprising an upper part and a lower part, wherein the upper part is configured to be detachably axially connected to the lower part by a rotary connection in order to fix the carrier element between the upper part and the lower part, the rotary connection is formed by a stud provided on the lower part and an opening provided on the upper part, into which the stud is to be screwed, and the rotary connection is implemented such that the rotary connection is released again after defined screwing of the stud into the opening, such that the stud is locked in the opening with axial play, wherein the lower part has a disk-shaped attachment, whose layer thickness decreases toward the edge, and wherein the carrier element is fixed between the upper part and the lower part of the at least one multi-part support element, and the disk-shaped attachment of the lower part of the at least one multi-part support element is accommodated in the bore such that the at least one multi-part support element does not protrude from the carrier element at the bottom of the carrier element.

9. A kiln shelf comprising a lower carrier element, at least one upper carrier element, and at least two multi-part support elements, each multi-part support element comprising an upper part and a lower part, wherein the upper part is configured to be detachably axially connected to the lower part by a rotary connection in order to fix the upper or lower carrier element between the upper part and the lower part, the rotary connection is formed by a stud provided on the lower part and an opening provided on the upper part, into which the stud is to be screwed, and the rotary connection is implemented such that the rotary connection is released again after defined screwing of the stud into the opening, such that the stud is locked in the opening with axial play, wherein the lower part has a disk-shaped attachment, whose layer thickness decreases toward the edge, and wherein each of the lower carrier element and the upper carrier element is fixed in one the two multi-part support elements between the upper part and the lower part, and the bottom of the lower part of the support element, which fixes the upper carrier element, or the bottom of the upper carrier element rests on the upper part or the tubular support of the support element, which fixes the lower carrier element.

10. The kiln shelf according to claim 9, wherein the lower carrier element and/or the at least one upper carrier element is plate-shaped.

11. The kiln shelf according to claim 9, wherein the lower carrier element and/or the at least one upper carrier element is implemented as a plate stand.

* * * * *